United States Patent [19]

Lund et al.

[11] Patent Number: 4,611,432

[45] Date of Patent: Sep. 16, 1986

[54] WINDOW, ESPECIALLY FOR INSTALLATION IN AN INCLINED ROOF

[75] Inventors: Arne Lund, Østbirk; Egon Nowakowski, Hovedgård; Elgård Nielsen, Østbirk; Per G. Nielsen, Horsens, all of Denmark

[73] Assignee: V. Kann Rasmussen Industri A/S, Søborg, Denmark

[21] Appl. No.: 702,233

[22] PCT Filed: Jun. 28, 1984

[86] PCT No.: PCT/DK84/00062

§ 371 Date: Feb. 11, 1985

§ 102(e) Date: Feb. 11, 1985

[87] PCT Pub. No.: WO85/00195

PCT Pub. Date: Jan. 17, 1985

[30] Foreign Application Priority Data

Jun. 29, 1983 [DK] Denmark ..... 2988/83

[51] Int. Cl.[4] ..... E05D 15/48

[52] U.S. Cl. ..... 49/192; 49/153; 49/390; 49/394

[58] Field of Search ..... 49/192, 394, 390, 153, 49/253

[56] References Cited

U.S. PATENT DOCUMENTS

| | | | |
|---|---|---|---|
| 465,097 | 12/1891 | Liddle | 49/192 |
| 953,210 | 3/1910 | Lawrence | 49/394 |
| 1,694,662 | 12/1928 | Nicles | 49/153 |
| 1,728,040 | 9/1929 | Carl | 49/192 |
| 2,151,103 | 3/1939 | Hayne | 49/394 |
| 3,357,135 | 12/1967 | Russ et al. | 49/390 |
| 3,362,107 | 1/1968 | Ewing | 49/394 |
| 3,676,955 | 7/1972 | Schacht | 49/192 |
| 4,449,327 | 5/1984 | Nielsen | 49/390 |
| 4,486,978 | 12/1984 | Frank | 49/192 |

FOREIGN PATENT DOCUMENTS

| | | | |
|---|---|---|---|
| 84505 | 10/1957 | Denmark | 49/192 |
| 1683199 | 12/1971 | Fed. Rep. of Germany . | |
| 2628691 | 1/1978 | Fed. Rep. of Germany | 49/192 |
| 2900003 | 3/1981 | Fed. Rep. of Germany . | |
| 3121322 | 12/1982 | Fed. Rep. of Germany . | |
| 2358526 | 7/1982 | France . | |
| 139835 | 7/1977 | Norway . | |
| 81/00082 | 3/1982 | PCT Int'l Appl. . | |
| 330335 | 11/1970 | Sweden . | |
| 292631 | 11/1975 | Sweden . | |
| 1005310 | 9/1965 | United Kingdom | 49/153 |
| 1358982 | 7/1974 | United Kingdom | 49/153 |

*Primary Examiner*—Victor N. Sakran

*Attorney, Agent, or Firm*—Lane & Aitken

[57] ABSTRACT

In a window comprising a main frame (1), an intermediate frame (3) hinged at the top of the latter and a sash (7) which is journalled as a pivot sash in the intermediate frame, said intermediate frame (3) is provided with an arresting means (5) in the area of the pivoting axis (2), said arresting means normally being engaged with an associate arresting means (6) in the main frame. The arrest can be disengaged by means of a release handle (9) which is placed on the inner side of the main frame (1), and the window can then serve as an emergency exit, as the intermediate frame (3) with the sash (7) is swung clear of the main frame due to a permanent urging of the intermediate frame in its opening direction.

3 Claims, 1 Drawing Figure

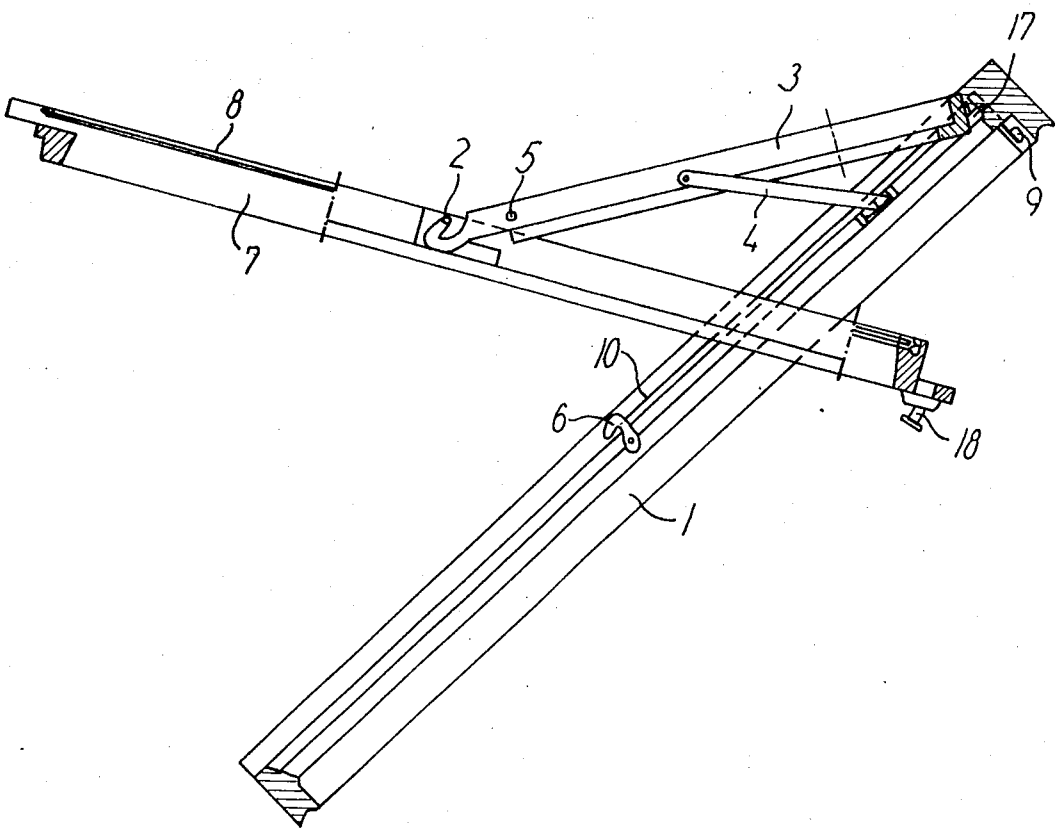
17
9
3
4
5
2
8
7
18
10
6
1

WINDOW, ESPECIALLY FOR INSTALLATION IN AN INCLINED ROOF

BACKGROUND OF THE INVENTION

1. Field of the Invention

This invention relates to a window particularly designed to be mounted in an inclined roof comprising, a main frame and an element that may be opened in relation thereto that includes an intermediate frame which is hinged to the main frame at the top thereof and is permanently urged in its opening direction, and a pane-supporting sash which in the area of its horizontal centre axis is pivotally mounted in the intermediate frame. Said element and main frame are provided, at least in one side of the window, with associate arresting means, as is shown in U.S. Pat. No. 4,449,327 and the published Danish patent application No. 1831/82 and WO 82/00842.

2. Discussion of Related Art

In the known windows of this type the arresting means of the openable element are mounted on the sash in the vicinity of its pivot axis and are adapted, by the opening and closing movement of the window which is effectuated by a coordinated swinging of the sash in relation to the intermediate frame and of the latter in relation to the main frame, to engage and disengage the corresponding arresting means of the main frame. After the engagement has been established, the sash and the intermediate frame may be locked together at their upper edges, and the sash of the window will then be kept in a closed or a slightly open position. Thus, the manual operating means may be reduced to only one locking or connecting device, namely between the sash and the intermediate frame.

When such a window is to be opened, the sash must first be released from the intermediate frame and then swung clear of the arresting means of the main frame. After this the sash may again be locked together with the intermediate frame which has also been swung open, and may function together with this intermediate frame as a top-hinged window sash, or the sash may remain released from the intermediate frame and then function as a pivoted or tilting sash journalled in the outswung intermediate frame.

A purpose of the invention is to provide a window of the above-mentioned type and which satisfies better than the known embodiments the requirements of an emergency exit window.

This is achieved by the invention in that the arresting means of the openable element are mounted on the intermediate frame, and in that the associate arresting means are releaseable by means of an internal release handle.

By the normal operation (opening and closing) of this window the associate arresting means remain engaged so that the intermediate frame acts as an integral part of the main frame. In this situation the sash can therefore be considered journalled in the main frame. Only if the window shall exceptionally serve as an emergency exit, the release handle is used to disengage the arrest, and the permanent urging of the intermediate frame will then cause the entire openable element, that is the intermediate frame and the sash in unison, to be swung outwardly and upwardly, and by using an appropriately designed hinge between the main frame and the intermediate frame and appropriately dimensioned and located urging means, such as gas pressure springs, such an extensive swinging up of the openable element can be assured that the latter will not obstruct an escape through the aperture defined by the main frame.

BRIEF DESCRIPTION OF THE DRAWING

An embodiment of the window according to the invention is illustrated schematically on the drawing which represents a sectional elevation of the window showing the intermediate frame in an outswung position and, for the sake of clarity, the sash released from the intermediate frame.

DETAILED DESCRIPTION OF A PREFERRED EMBODIMENT

The main frame 1 shown on the drawing is connected through a hinge 17 at its top with an intermediate frame 3 which is permanently urged in its opening direction, for instance by a couple of gas pressure springs or springloaded articulated links 4 which at the ends are pivotally connected with the side members of the main frame and the intermediate frame. A tiltable sash 7 with one or more panes 8 is mounted in the intermediate frame 3, the tilting axis being indicated by 2. Close to this tilting axis the intermediate frame 3 is provided with an arresting means formed by a pin 5 by which the intermediate frame 3 and the main frame 1 may be coupled together when the intermediate frame is swung into abutment against the latter, the pin 5 then being held firmly by an associate arresting means formed by a catch 6 which is pivotal in the main frame 1. Through a wire 10 this catch, together with a possible similar catch in the other side of the window, is connected with a release handle 9 which may be countersunk in the top member of the main frame 1 and may be sealed, if desired. A pull at this handle 9 will release the catches 6 from the pins 5, and the urging means 4 acting on the intermediate frame 3 will then cause an outswinging of the latter through an angle of e.g. 70 degrees, although the drawing shows a much smaller angle.

In the normal, arrested position of the intermediate frame 3 the sash can be operated as an ordinary pivot sash, for instance by using a handle 18 mounted at the top of the sash and which is connected with a coupling device which at this place permits a releaseable locking of the sash with the intermediate frame. If desired, an operation of the handle 18 may also be effectuated after the arresting of the main frame 1 and the intermediate frame 3 has been released.

We claim:

1. A tilting window assembly adapted for installation in an inclined roof comprising:

a main frame;

an intermediate frame hingedly mounted to said main frame at the top thereof;

a sash pivotally mounted in the area of its horizontal center line to said intermediate frame;

urging means to permanently urge said intermediate frame in its opening direction relative to said main frame;

associate arresting means provided on at least one of said main frame and said intermediate frame for maintaining said intermediate frame in its closed position relative to said main frame against the force of said urging means; and a handle provided on the internal side of the window assembly and operable to release said associate arresting means in case of an emergency situation.

2. A window assembly according to claim 1, characterized in that the associate arresting means comprise a pin fixed to the intermediate frame and a catch which is pivotally mounted on the main frame to releasably engage with the pin.

3. A window assembly according to claim 2 and comprising arresting means at both sides of the window, characterized in that the two catches are connected to a common handle.

* * * * *